US008820592B2

(12) United States Patent
Boisdequin

(10) Patent No.: US 8,820,592 B2
(45) Date of Patent: Sep. 2, 2014

(54) LADLE SHROUD TRANSPORT/STORAGE DEVICE FOR TRANSFERRING LIQUID METAL

(75) Inventor: Vincent Boisdequin, Naast (BE)

(73) Assignee: Vesuvius Group S.A., Ghlin (BE)

( * ) Notice: Subject to any disclaimer, the term of this patent is extended or adjusted under 35 U.S.C. 154(b) by 313 days.

(21) Appl. No.: 13/130,323

(22) PCT Filed: Nov. 19, 2009

(86) PCT No.: PCT/EP2009/008254
§ 371 (c)(1),
(2), (4) Date: Jun. 7, 2011

(87) PCT Pub. No.: WO2010/057645
PCT Pub. Date: May 27, 2010

(65) Prior Publication Data

US 2011/0240246 A1 Oct. 6, 2011

(30) Foreign Application Priority Data

Nov. 20, 2008 (EP) ..... 08169505

(51) Int. Cl.
*C21B 7/12* (2006.01)

(52) U.S. Cl.
USPC ..... 222/590; 266/287; 222/607

(58) Field of Classification Search
USPC ..... 222/606, 607, 590; 266/135, 287
See application file for complete search history.

(56) References Cited

U.S. PATENT DOCUMENTS

| | | | | |
|---|---|---|---|---|
| 5,219,515 | A | 6/1993 | Chabot et al. | |
| 5,665,264 | A * | 9/1997 | Sato et al. | 222/607 |
| 5,971,060 | A | 10/1999 | Ikeda et al. | |
| 2008/0314938 | A1 | 12/2008 | Ebner et al. | |

FOREIGN PATENT DOCUMENTS

| | | | |
|---|---|---|---|
| EP | 498684 | | 12/1992 |
| EP | 0858851 | A1 | 8/1998 |
| JP | 7164117 | A | 6/1995 |
| JP | 08019854 | | 1/1996 |
| JP | 9108825 | A | 4/1997 |
| JP | 09201657 | | 8/1997 |
| KR | 20040021971 | A | 3/2004 |
| WO | 2007057061 | A | 5/2007 |

* cited by examiner

*Primary Examiner* — Scott Kastler
(74) *Attorney, Agent, or Firm* — Thomas Clinton; Donald M. Satinu

(57) ABSTRACT

A device enables the transporting and storing of at least one ladle shroud for a liquid metal casting plant, the ladle shroud having a channel through which liquid metal passes and essentially extending along an axis. The device also includes a rack designed to store the ladle shroud in a use position wherein the axis of the channel is vertical, the rack providing an access from the outside to a lateral face of the shroud when the latter is in its use position.

17 Claims, 2 Drawing Sheets

LADLE SHROUD TRANSPORT/STORAGE DEVICE FOR TRANSFERRING LIQUID METAL

BACKGROUND OF THE INVENTION (1) Field of the Invention

The present invention relates to a method of casting liquid metal, particularly steel, more particularly to a method relating to the positioning of a ladle shroud in a casting plant.

(2) Description of the Related Art

A ladle shroud is a tube having a channel which extends essentially along an axis, this being vertical when the tube is in the use position, and allows liquid metal from a metallurgical vessel, such as a ladle, to flow into a tundish. It is inserted into the plant so as to have an upper end in contact with a component upstream of the plant, integral with the ladle, and a lower end immersed in a tundish.

In the prior art, ladle shrouds are delivered on a casting platform packaged in a box. They are more particularly presented in the box in a recumbent position, in which the axis of the channel of the shroud lies horizontally. The shrouds are held together and in the box by metal rings surrounding them.

It is known that, to insert a shroud into the plant, the shroud is gripped in its use position by means of a handling arm comprising a gripper surrounding the shroud, the arm being controlled manually by an operator. Document EP-A1-0 858 851 describes such a handling arm.

To prepare the shroud for this operation, an operator opens the box and cuts the metal rings surrounding the shrouds. These may then be spread out on the floor of the platform. Each shroud is then placed individually by the operators, by rotating them so that they reach the use position.

However, the ladle shrouds, because of their size and their purpose, are heavy and bulky components which generally weigh more than 50 kilograms. Handling these shrouds is therefore very arduous for the operators and may take a long time. This is liable to delay the fitting of the shroud into the casting plant, therefore causing many undesirable effects.

BRIEF SUMMARY OF THE INVENTION

The object of the present invention is to remedy these drawbacks by providing a ladle shroud transport/storage device that can used in a casting method and making it possible to simplify the fitting of the ladle shrouds in the casting plant.

For this purpose, one subject of the invention is a device for transporting and storing at least one ladle shroud for a liquid metal casting plant, the ladle shroud having a channel through which liquid metal passes and essentially extending along an axis, the device including a rack designed to store the ladle shroud in a use position in which the axis of the channel is vertical, the rack providing an access from the outside to a lateral face of the shroud when the latter is in its use position.

Thus, by virtue of this device, the ladle shrouds arrive at the casting platform in their use position. It is therefore not necessary for the operators to carry out on site an operation of moving the shroud from their recumbent position to their use position.

Furthermore, since the lateral face of the shroud is accessible in the device from the outside, the handling arm may directly grip the shroud in the device and fit it into the plant. Fitting the shroud therefore does not require an arduous step of the shroud being removed manually by an operator. The working conditions for the operators are therefore considerably improved.

In addition, this device reduces the number of steps, especially the number of shroud removal steps, carried out on the platform and thus simplifies the insertion of the shroud into the casting plant. The risks of the casting operations being delayed due to lengthy or difficult fitting of the shroud into the plant are therefore greatly reduced.

The device also has many additional advantages. In particular, it helps to improve the quality and the lifetime of the ladle shrouds. Specifically, ladle shrouds are made of a material based on alumina-graphite, which has a tendency to oxidize at the temperature of the liquid metal, which is for example close to 1500° C. in the case of steel. They are therefore provided with an air-impermeable glaze enabling them to resist being oxidized at such temperatures. However, during the operation of transporting the shrouds and also the operation of unpacking them, as carried out in the prior art, the shrouds may knock against one another and the glaze on the external faces of the shrouds is therefore likely to flake off. Shrouds locally devoid of glaze are not as resistant to the temperature and their lifetime is reduced. The shrouds are even liable to break during their use, thus incurring substantial losses of efficiency of the casting, or even work accidents. The device according to the invention enables these problems to be solved by storing each shroud separately and in a confined space, which is specific to it during transport, and making the operation of unpacking the shrouds superfluous. As a result, the proportion of shrouds damaged before their use is reduced, thereby making the casting operation more reliable and more profitable.

The invention may also comprise one or more of the features in the following list:

the device includes means for positioning the shroud relative to the rack and/or means for positioning the rack relative to a support, such as a casting platform. These positioning means, especially when they are coupled, allow simpler interaction of the rack with a shroud-handling device comprising a robot responsible for gripping and replacing the shrouds in such a device and/or in the casting plant. Specifically, this robot knows the precise position of each shroud without being provided with perfected detection means such as viewing means. This therefore enables the insertion of the shrouds into the casting plant to be reliably automated without thereby considerably increasing the costs associated with the tooling necessary for inserting a shroud into the plant;

the device comprises means for immobilizing the shroud relative to the rack, these immobilizing means preferably also forming means for positioning the shroud. The immobilizing means make it possible to further reduce the risks of damaging the shrouds during transport since they are in a fixed position during this operation and cannot even strike the walls defining the location of the device in which each shroud is located. If the immobilizing means also form positioning means, it helps to reduce the complexity of the device, the immobilizing means comprise a plurality of pins, preferably three pins, capable of cooperating with complementarily shaped notches in the shroud. These notches may be placed directly on the shroud or on a frame surrounding the shroud. When three pins are present on the device, this enables the shroud to be immobilized in a non-hyperstatic situation;

the device comprises means for suspending the shroud by one end corresponding to the inlet of the latter, forming the upper end of the shroud when it is in its use position, thereby simplifying the way in which the shroud is positioned and immobilized.

Another subject of the present invention is an installation for storing ladle shrouds for casting liquid metal, comprising at least two transport/storage devices according to the invention and at least one handling device capable of moving a shroud between the transport/storage devices and a casting plant.

Furthermore, the storage installation may also include a device for cleaning the shrouds, especially by injecting oxygen. This enables the shrouds to be cleaned before they are optionally reused so as to avoid deposits of solid metal in the shrouds, such deposits being liable to disturb the flow therein.

The installation may also comprise a platform on which the transport/storage devices and preferably the handling and/or cleaning device are provided, the platform and each transport/storage device comprising complementary means for positioning the device relative to the platform.

The installation may also comprise at least one other storage device placed on the platform and comprising one or more shrouds in reserve. This may in particular be useful in the case in which the last fresh shroud of a device were to break during its use and in particular prevent any dead time in the casting process.

Another subject of the invention is a method of casting liquid metal, comprising the following steps:

a shroud is removed from a first rack according to the invention;

this shroud is inserted into the casting plant;

the casting operations are carried out;

the shroud is extracted from the casting plant; and the shroud is put back in a second rack according to the invention.

The first and second transport/storage devices as defined may be the same or different, each of these devices possibly including one or more of the abovementioned features.

This method ensures that the shrouds are handled and stored in a simple manner from the start to the end of their use, and thus saves time.

Furthermore, by virtue of this method, the transport/storage device forms a support enabling the spent shrouds to be easily taken up for the purpose of recycling them without the operators having to carry out the operation to do so. This storage for recycling purposes is in fact carried out automatically, thereby also avoiding the operators having to return types of waste other than the shrouds to the supplier carrying out the recycling operation.

In addition, this method enables the shrouds that have just been used to be kept away from any contact with an operator or with fragile equipment, something which is particularly advantageous in view of the very high temperature of the shrouds after their use, and in particular operator safety is guaranteed.

In one particular embodiment, before the step of putting the shroud back in a rack, the insertion, casting and extraction steps are repeated for one or more other casting plants.

Thus, the same shroud may be used in several plants before being returned to a rack. The number of plants into which the shroud has to be fitted may be determined using objective data regarding the average lifetime of the shrouds.

In one particular embodiment, before a shroud is inserted into another casting plant, a shroud cleaning step is carried out, especially by injecting oxygen.

Advantageously, the insertion of the shroud into another casting plant is carried out in an angular orientation, along an axis corresponding to the axis of the channel of the shroud, which is different from the orientation in which the shroud was inserted into the previous plant.

In this way, the lifetime of the shroud is increased as the wear on the internal wall of the shroud is better distributed by changing the orientation of the latter relative to the plant. The wear on the surface of the shroud in contact with the upstream component of the device is also distributed.

Furthermore, before the first, removal step, the transport/storage devices are placed on the platform in predetermined positions so as to make it easier for the method to be implemented by an automatic handling device.

Advantageously, it is detected whether a location in a transport/storage device is storing a shroud and, where appropriate, the shroud stored in this location is removed therefrom. In this way, the unnecessary movement steps performed by the automatic handling device are avoided.

BRIEF DESCRIPTION OF THE SEVERAL VIEWS OF THE DRAWINGS

The invention will be better understood on reading the following description given solely by way of example and with reference to the drawings in which.

DETAILED DESCRIPTION OF THE INVENTION

Figure 1:
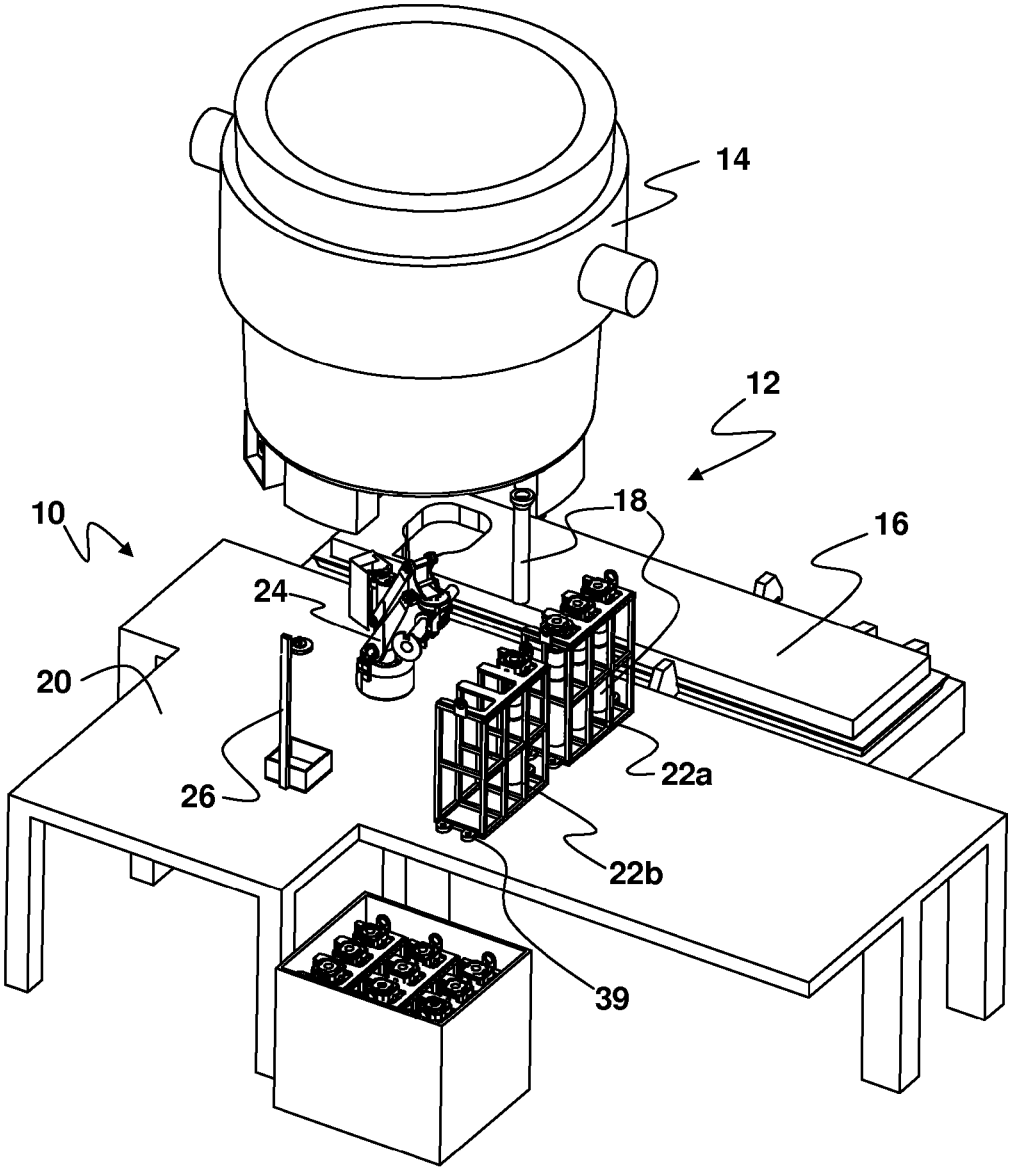
FIG. 1 is a schematic view of a ladle shroud storage installation according to one embodiment of the invention.

FIG. 1 shows a ladle shroud storage installation 10. This installation is located close to a casting plant 12 comprising a metallurgical vessel 14 comprising especially a ladle for containing liquid metal before it is cast and a tundish 16, enabling the liquid metal to be distributed into the various casting moulds, located downstream of the ladle.

The object of the installation 10 is to store the ladle shrouds 18 for transferring liquid metal from the ladle 14 to the tundish 16 during a casting run, so as to make it easier to fit them into the casting plant 12, and comprising for this purpose a channel for the liquid metal to flow from the ladle to the tundish.

The storage installation 10 will now be described in greater detail. This storage installation includes a platform 20 on which there are placed storage devices, in this case racks 22*a* and 22*b*, each rack having three locations for storing ladle shrouds 18, and also a handling device 24, which is capable of, and configured for, moving a shroud between the various storage devices and the casting plant 12, and a cleaning device 26, in particular enabling the ladle shrouds to be cleaned by injecting oxygen.

As may be seen in FIG. 1, the transport/storage devices 22 are brought to the storage installation in a box, with their locations filled with shrouds. They therefore also serve for transporting the shrouds.

A transport/storage device, in particular a rack 22 of the installation 10, will now be more precisely described with reference to FIG. 2.

As may be seen, this transport/storage device is formed by a rack having three compartments 30*a*, 30*b*, 30*c* each forming a location for storing a ladle shroud.

The rack 22 is designed so that the shroud in each of the compartments 30*a*, 30*b*, 30*c* is in the use position, that is to say the position in which the channel 31 of the shroud is vertical.

Each compartment has three closed sides, that is to say these sides each have a wall through which the shroud 18 cannot pass in its use position, and each compartment has, on one face of the rack, an open side leaving an access 33 to each ladle shroud 18, especially the lateral face of the shroud when it is in the use position, so that a handling device can take hold of this shroud in the rack 22.

Figure 3:
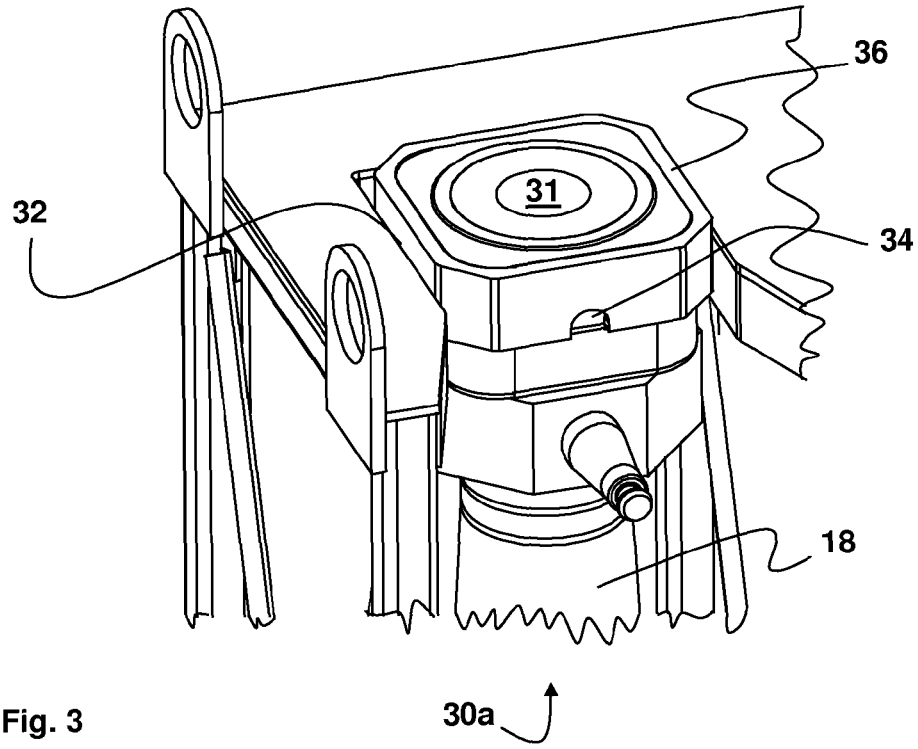
FIG. 3 is a perspective view of a detail of the device shown in FIG. 2.

The rack 22 further includes, in each compartment 30*a*, 30*b*, 30*c*, means for suspending the shroud via the inlet thereof. These means are also visible in FIG. 3 and consist of pins 32 projecting from the upper end of the rack and intended to cooperate with notches in the shroud. In particular, the rack includes, for each compartment 30*a*, 30*b*, 30*c*, three pins 32 each placed at the upper end on a closed side of the compartment. The pins 32 also serve as immobilizing and positioning means to immobilize and position the shroud correctly in each of the compartments and to immobilize the shroud relative to the rack 22.

The shroud 18 has four notches 34, one notch being located on each side of a square head 36 of the shroud 18. The pins 32 and the notches 34 are designed so that a given pin can fit into all the notches, it being possible for the shroud to be immobilized relative to the compartment whenever the notch 34 in the compartment cooperates with a given pin on the rack 22. The shroud is thus configured to be transported and stored in the rack.

Figure 2:
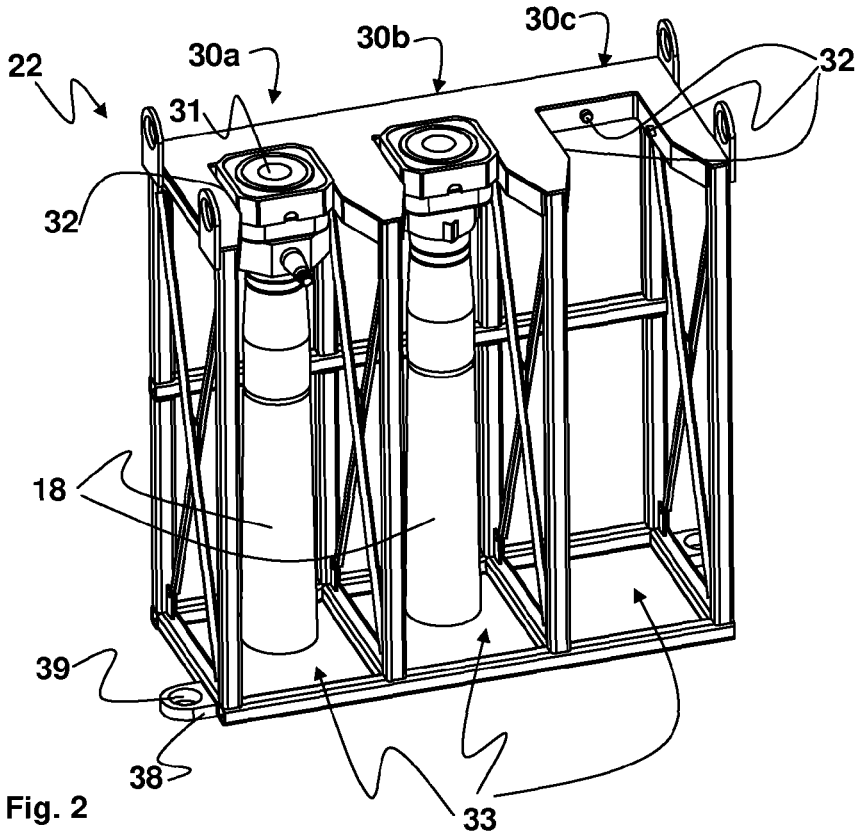
FIG. 2 is a perspective view of a ladle shroud transport/storage device according to one particular embodiment of the invention, such a device belonging to the plant shown in FIG. 1.

As may be seen in FIG. 2, the rack 22 at its lower end also includes tabs 38 provided with holes 39. The holes 39 are configured and intended to cooperate with pins on the platform (not shown in the figure). The homes and pins thus form complementary means for positioning the storage devices relative to the platform. This makes it easier to take hold of the shroud, the position of which relative to the platform is perfectly defined, by the handling device 24, especially when the latter is automatic.

The storage installation is not limited to what has been described above. In particular, it is conceivable for this installation to be provided with a means enabling the racks to be more easily placed on said installation, especially a conveyor. In addition, such an installation may include additional storage devices, especially a reserve storage device, making it possible for example to store fresh shrouds that would be used in the event of a problem.

Likewise, the installation need not be provided with a cleaning device 26, and the handling device 24 may be actuated by an operator.

In addition, each storage device 22 may have one or more compartments, the number of these not being limited to three. Furthermore, the means for suspending the shroud in the storage device 22 may comprise only two pins.

It is also conceivable for the shrouds to be positioned differently in the storage device, especially so that they rest on the bottom of this device. The storage device may also have closed sides, one of the closed sides having a removable or movable panel so as to provide an access to a lateral face of the shroud in its use position.

The storage devices could also be used for storing differently shaped shrouds or casting components formed by the combination of a shroud and a frame.

The means for positioning the rack relative to the platform are optional or are differently shaped from those described.

Furthermore, the two storage devices 22*a*, 22*b* placed in the installation need not be identical.

A method of casting liquid metal carried out using the installation of FIG. 1 will now be described.

The box containing the storage devices 22 is firstly received and one of these full devices, especially the device 22*a*, is taken to the platform. It may be taken to the platform by a conveyor. The platform already supports an empty device 22*b*.

The racks 22*a* and 22*b* are then fitted using the complementary positioning means (for example the holes 39 in the tabs 38 cooperating with pins) of rack 22*a*, 22*b* and the platform. The racks are therefore placed in a defined or predetermined position on the platform.

Next, a shroud is removed from a location in the first rack 22*a* using the handling device 24. This operation takes place only if the handling device 24 has detected, especially using conventional detection means, that a shroud is present in the corresponding location in the rack.

Once the handling device 24 is bearing the shroud, the latter is inserted into the casting plant 12, then extracted from the casting plant 12, using the device 24, once the casting operation has taken place.

The shroud is then cleaned or inserted into the oxygen-injection cleaning device 26, thereby enabling the deposits of solid material in this shroud to be removed, and then the shroud is reinserted into a new casting plant, the empty ladle 14 then having been replaced with a new, identical ladle.

This operation of reinserting the shroud into the plant and extracting it therefrom may be repeated a certain number of times. Then, when it is considered that the shroud has been used sufficiently, it is extracted from the casting plant 12 in which it was placed and put back into the second rack 22*b*.

The method is then restarted with another shroud stored in the first rack 22*a*.

When the first rack 22*a* is empty and therefore no fresh shroud therefore remains therein, the second rack 22*b* is completely filled with spent shrouds. The second rack 22*b* comprising the spent shrouds is then conveyed away from the storage installation and recovered so that it can be sent to a recycling site where the shrouds will be recycled.

Next, the first rack 22*a* is moved to the location in which the rack 22*b* was stored, and a new rack filled with fresh shrouds is moved to the location in which the rack 22*a* was previously stored. The method may thus continue in this way as described above.

As a variant, it is conceivable, when the device includes means for controlling the orientation enabling it to adopt several orientations in the casting plant, for the shroud to be inserted in a first angular orientation, or first orientation relative to the axis of its channel into a first casting plant during the first step of introducing the shroud and then for it to be reinserted in a second orientation, or even a third orientation, into one or more other casting plants.

To do this, the storage installation could include a specific location in which the handling device places the shroud and then repositions it in another orientation. It could also include means for changing the orientation, which includes a pivoting base and in which the handling device 24 would place the shroud. This base would then pivot and the handling device would take hold of the shroud in the same orientation as previously in order to reinsert it into the casting plant. Such means could for example form part of the cleaning device.

Numerous modifications and variations of the present invention are possible. It is, therefore, to be understood that within the scope of the following claims, the invention may be practiced otherwise than as specifically described.

The invention claimed is:

1. Device for transporting and storing at least one ladle shroud for a liquid metal casting plant, the ladle shroud having a channel through which liquid metal passes and essentially extending along an axis, wherein the device comprises a rack configured to store the ladle shroud in a use position in which the axis of the channel is vertical, the rack providing an access from the outside to a lateral face of the shroud when the latter is in its use position, wherein the device comprises at least three pins projecting from the rack, said at least three pins configured to immobilize and position the shroud relative to the rack.

2. Device according to claim 1, wherein the at least three pins are configured to cooperate with complementarily shaped notches in the shroud.

3. Device according to claim 1, further comprising means for positioning the rack relative to a support.

4. Device according to claim 1, comprising means for suspending the shroud by one end, corresponding to the inlet of said shroud.

5. Ladle shroud configured for being transported to and stored in a device according to claim 2, wherein the ladle shroud comprises a plurality of notches configured to cooperate with pins on the rack.

6. Installation for storing ladle shrouds for liquid metal casting, wherein the installation comprises at least two transport/storage devices according to claim 1, and at least one device for handling a tube, wherein the device is configured to move a shroud between the transport/storage devices and a casting plant.

7. Installation according to claim 6, further comprising at least one device for cleaning the shrouds.

8. Installation according to claim 6, further comprising a platform on which the transport/storage devices are provided, the platform and each transport/storage device comprising complementary means for positioning the device relative to the platform.

9. Method of casting liquid metal, comprising the following steps:

removing a shroud from a first rack according to claim 1;

inserting a shroud into a casting plant;

carrying out casting operations;

extracting the shroud from the casting plant; and putting the shroud into a second rack according to claim 1.

10. Method according to claim 9, wherein, before the step of putting the shroud into a second rack, the insertion, casting and extraction steps are reproduced for at least one other ladle.

11. Method according to claim 10, wherein, before the reproduced insertion step, a shroud cleaning step is carried out.

12. Method according to claim 10, wherein the operation of the reproduced insertion step is carried out in an angular orientation, along an axis corresponding to the axis of the channel of the shroud, which is different from the orientation wherein the shroud was inserted into the previous plant.

13. Method according to claim 9, wherein, before the first, removal step, the transport/storage devices are placed on a platform.

14. Method according to claim 11 wherein the shroud cleaning step comprises injecting oxygen.

15. Device according to claim 2, wherein the at least three pins comprise three pins.

16. Device according to claim 3, wherein the support comprises a platform.

17. Device according to claim 5, wherein the plurality of notches comprises at least three notches.

* * * * *